US005637122A

United States Patent [19]

Brown

[11] Patent Number: 5,637,122

[45] **Date of Patent: *Jun. 10, 1997**

[54] ELECTROSTATIC PYRITE ASH AND TOXIC MINERAL SEPARATOR

[76] Inventor: David K. Brown, 4602 Briary Dr., Apt. E, Richmond, Va. 23224

[ * ] Notice: The term of this patent shall not extend beyond the expiration date of Pat. No. 5,275,631.

[21] Appl. No.: 519,924

[22] Filed: Aug. 28, 1995

Related U.S. Application Data

[63] Continuation-in-part of Ser. No. 368,497, Jan. 3, 1995.

[51] Int. Cl.[6] ..... C10L 9/00

[52] U.S. Cl. ..... 44/505; 44/621; 44/622; 44/626; 44/627; 44/629

[58] Field of Search ..... 44/505, 621, 622, 44/626, 627, 629

[56] References Cited

U.S. PATENT DOCUMENTS 4,482,351 11/1984 Kitazawa et al. ..... 44/627

4,574,045 3/1986 Crossmore, Jr. ..... 44/622

5,275,631 1/1994 Brown et al. ..... 44/631

*Primary Examiner*—Jerry D. Johnson

*Attorney, Agent, or Firm*—Walter G. Finch, Esq.; Nancy A. Smith, Esq.

[57] ABSTRACT

The invention relates to electrostatic separation of coal from toxic and pyritic elements and ash compounds. More particularly this invention relates to separation of coal from refuse material by imparting opposite electrostatic charges to coal and refuse particles, passing them between oppositely charged electrodes and mechanically separating the electrostatically attracted diverging coal and refuse particles. The electrostatic attraction and divergent separation process is maximized by performing the charging and separation functions within a continuously vacuum reduced atmosphere. The use of a vacuum exhaust to continuously remove water and water vapor can prevent charge dissipation of the coal particles through charge transfer to water and water vapor. Additionally, the vacuum reduced atmosphere can prevent impairment of electrostatic influence due to gas turbulence.

6 Claims, 2 Drawing Sheets

| Tyler Screen Scale | Particle Diameter | Range D |
|---|---|---|
| 115 mesh | 0.0049 | 5.7 inches |
| 200 mesh | 0.0029 | 3.4 inches |
| 270 mesh | 0.0021 | 2.4 inches |
| 325 mesh | 0.0017 | 2.0 inches |
| 400 mesh | 0.0015 | 1.7 inches |

FIG. 2

| Tyler Screen Scale | Particle Diameter | Range D |
|---|---|---|
| 115 mesh | 0.0049 | 51 inches |
| 200 mesh | 0.0029 | 30 inches |
| 270 mesh | 0.0021 | 21 inches |
| 325 mesh | 0.0017 | 18 inches |
| 400 mesh | 0.0015 | 15 inches |

FIG. 3

ELECTROSTATIC PYRITE ASH AND TOXIC MINERAL SEPARATOR

BACKGROUND OF TEE INVENTION

This application is a continuation-in-part of U.S. patent application Ser. No. 08/368,497 filed Jan. 3, 1995.

Coal burned in utility and industrial boilers contains various amounts of mineral impurities which, when combusted, produce sulfur dioxide—which can lead to "acid rain"—fly ash—which contributes to smog—and airborne toxic compounds. Removal of sulfur dioxide and fly ash from flue gas is expensive. Removal from flue gas of compounds bearing toxic elements apparently is not presently being accomplished in any way at all, except perhaps in some coincidental way.

Brown, et al, in U.S. Pat. No. 5,275,631 describes a centrifugal coal pulverizer combined with electrostatic and aerodynamic separation means arranged concentric to the pulverizer and directed at relatively economical removal of unwanted mineral compounds from coal prior to combustion. Toxic elements are bound in mineral compounds in ways similar to iron and copper sulfides. These toxic compounds and ash-producing minerals can be made to take on electrically negative charges while coal particles are being charged positively through contact with copper, for example. In the approach described by Brown, however, the effectiveness of the electrostatic separator may be reduced by turbulence of air or water vapor released from coal during pulverization.

SUMMARY OF THE INVENTION

The invention relates to means for beneficiating coal by electrostatic separation of coal from toxic and pyritic elements and ash compounds. More particularly this invention relates to separation of coal from refuse material by imparting opposite electrostatic charges to coal and refuse particles, passing them between oppositely charged electrodes and mechanically separating the electrostatically attracted diverging coal and refuse particles. The electrostatic attraction and divergent separation process is maximized by performing the charging and separation functions within a continuously vacuum reduced atmosphere. The use of a vacuum exhaust to continuously remove water and water vapor can prevent charge dissipation of the coal particles through charge transfer to water and water vapor. Additionally, the vacuum reduced atmosphere can prevent impairment of electrostatic influence due to gas turbulence.

OBJECTS OF THE INVENTION

An object of this invention is to improve the technology of coal preparation.

Another object of this invention is provide a more economic means for making coal burning environmentally acceptable.

Still another object of this invention is to provide a means for preventing compounds bearing toxic trace elements from entering the environment surrounding coal burning facilities.

It is still yet another object of this invention to provide a means to increase the efficiency of electrostatic separation of coal particles from refuse particles.

It is a further object of this invention to provide a means to vacuum treat pulverized coal particles to remove water and water vapor before electrostatic separation.

It is still a further object of this invention to provide a means to heat pulverized coal particles to remove water and water vapor before electrostatic separation.

BRIEF DESCRIPTION OF THE DRAWINGS

These and other attendant advantages and objects of this invention will become obvious from the following detailed description and accompanying drawing in which:

FIG. 2 is a table providing the trajectory lengths of various particle sizes at standard temperature and pressure; and FIG. 3 is a table providing the trajectory lengths of various particle sizes at standard 20 percent ATM.

DETAILED DESCRIPTION OF THE DRAWINGS

Figure 1:
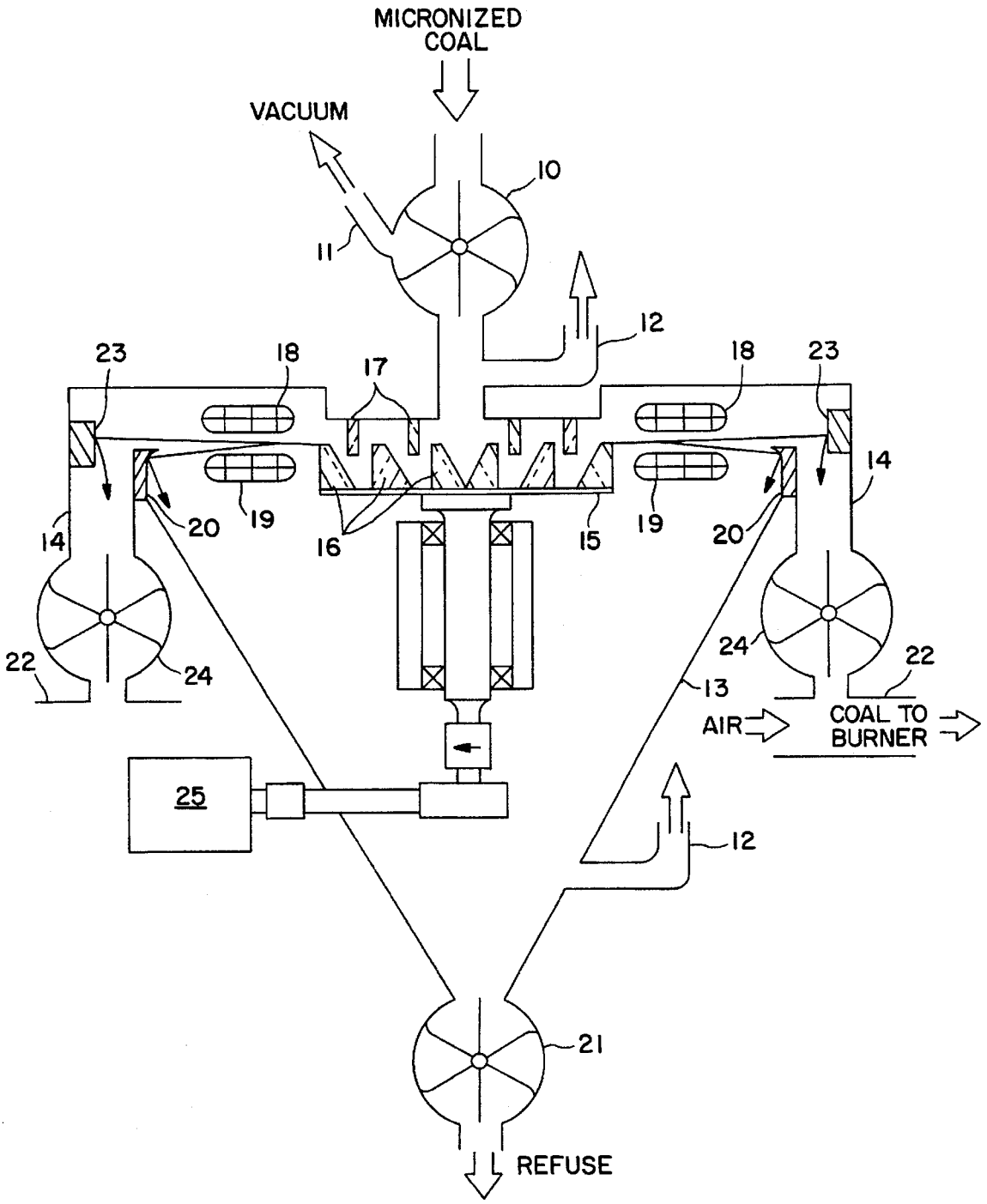
FIG. 1 is a cross sectional view through the electrostatic separator illustrating the novel aspects of this invention.

Now referring to FIG. 1, coal that has been pulverized to very small micron sizes in a pulverizing chamber is fed into rotary valve 10. Through orifices 11 and 12 a roughing pump draws water vapor and air out of the system at a rate which maintains a vacuum of between 0.001 to 0.67 atmosphere within the separator chamber 13 and egress chambers 14. As much as five or ten percent of coal by weight may be water. Water and water vapor in an around micronized coal may draw off the electrostatic charges carried by coal particles and refuse particles produced by fractocharging (that is electrostatic charging caused by comminuting coal) or other means of electrostatic charging. Therefore, it is beneficial to remove as much water and water vapor as practical prior to electrostatic charging.

Heating the coal to around 250 degrees Fahrenheit prior to pulverizing results in flashing the water to vapor upon micronizing. If the coal is five percent water, then 20 percent of the water is vaporized. That amounts to 400 cfm of water vapor for 35 tons per hour of coal, and assures that water vapor is the dominant gas in a sealed micronizer system. Additionally, heating after pulverizing can drive off some of the water vapor produced by the pulverization process.

Since water vapor is about 60 percent as dense as air the remaining, unexhausted gas entering the electrostatic separator along with the coal permits significantly longer particle trajectories than air at standard temperature and pressure (STP). FIG. 2 gives representative trajectory ranges of various particle sizes in air at STP. Trajectories longer than at STP are needed in order to transit the tangential distances from the outside of the rotating charging ring and through the electrodes to the splitter. FIG. 3 gives trajectory ranges for various particle sizes in 0.20 atmosphere and water vapor at 63 degrees Fahrenheit.

A coal pulverizer unit incorporating the separator system of FIG. 1 functions as follows. Rotary valve 10 feeds pulverized vacuumed coal onto rotating disc 15. A motor 25 drives a shaft which is connected to and in turn rotates disc 15. The rate of rotation can be varied by varying the speed of the motor 25. Disc 15 carries one or more copper alloy charging rings 16.

Coal is centrifugally forced up the slopes of charging rings 16 and thrown against static copper alloy charging rings 17 until it passes between annular electrodes 18 and 19. This process of rubbing the coal and refuse particles against the charging rings 16 and 17 imparts electrostatic charge to the particles before separation. The particles are both charged and centrifugally accelerated upon leaving the charging rings 16.

The trajectory of these particles passes through a pair of oppositely charged annular electrodes 18 and 19 for electrostatic separation. Electrode 19 is positively charged and exerts an attractive force on mineral refuse particles which have picked up negative charges through rubbing contact with copper rings 16 and 17. Electrode 18 is negatively charged and attracts coal particles which have become positively charged through rubbing contact with copper rings 16 and 17. Therefore, as coal and refuse particles pass between electrodes 18 and 19 they are separated by their respective charges.

Annular splitter blade 20 directs refuse particles into separator chamber 13 where they are collected in rotary valve 21. Rotary valve 21 maintains an air seal while conducting the refuse into disposal means.

Coal particles pass above annular splitter blade 20 and impact against annular wear ring 23. The coal particles then fall into each of several coal collector bins 14 each of which terminate at the bottom with an air seal rotary valve 24 through which coal is conducted into an air stream duct 22 which carries the coal to a burner for firing.

It is understood that the above description is illustrative only and that variations could be made without departing from the intended scope of the claims.

What is claimed is:

1. A device for separating mineral refuse from pulverized coal, comprising:

a rotating ring system having charging means for positively charging pulverized coal and negatively charging refuse particles;

a pair of annular oppositely charged electrodes located outside of said rotating ring system for separating said positively charged pulverized coal and said negatively charged refuse particles;

an annular splitter blade located outside of said annular electrodes; and means for drawing and maintaining within said charging means and said electrodes a reduced atmospheric pressure.

2. A device for separating mineral refuse from pulverized coal, comprising:

means for heating pulverized coal;

a rotating ring system having charging means for positively charging pulverized coal and negatively charging refuse particles;

a pair of annular oppositely charged electrodes located outside of said rotating ring system for separating said positively charged pulverized coal and said negatively charged refuse particles; and an annular splitter blade located outside of said annular electrodes.

3. A device for separating mineral refuse from pulverized coal as recited in claim 1, further comprising means for heating pulverized coal wherein said pulverized coal is heated prior to being received by said rotating ring system.

4. A device for separating mineral refuse from pulverized coal as recited in claims 1 or 2, wherein said rotating ring system further comprises a rotating disc having a first plurality of rings attached thereto and a static disc having a second plurality of rings attached thereto and wherein said charging means is copper alloy.

5. A device for separating mineral refuse from pulverized coal as recited in claims 1 or 2, wherein an upper electrode of said pair of annular oppositely charged electrodes is negatively charged thereby attracting upwardly positively charged pulverized coal and repelling downwardly negatively charged refuse particles and a lower electrode of said pair of annular oppositely charged electrodes is positively charged thereby attracting downwardly said negatively charged refuse particles and repelling upwardly said positively charged pulverized coal such that when a spray of particles passes between said electrodes they are effectively separated by their charges.

6. A device for separating mineral refuse from pulverized coal as recited in claims 1 or 2, further comprising means for varying the rotation rate of said rotating ring system.

* * * * *